US010010470B2

(12) United States Patent
Bradford

(10) Patent No.: US 10,010,470 B2
(45) Date of Patent: Jul. 3, 2018

(54) COMBINED EXERCISE AND MASSAGE DEVICE

(71) Applicant: Michelle Bradford, Seattle, WA (US)

(72) Inventor: Michelle Bradford, Seattle, WA (US)

( * ) Notice: Subject to any disclaimer, the term of this patent is extended or adjusted under 35 U.S.C. 154(b) by 68 days.

(21) Appl. No.: 15/295,212

(22) Filed: Oct. 17, 2016

(65) Prior Publication Data

US 2017/0258661 A1 Sep. 14, 2017

Related U.S. Application Data

(63) Continuation-in-part of application No. 15/069,528, filed on Mar. 14, 2016, now Pat. No. 9,833,653.

(51) Int. Cl.

| | |
|---|---|
| ***A63B 21/072*** | (2006.01) |
| ***A63B 21/075*** | (2006.01) |
| ***A61H 1/00*** | (2006.01) |
| ***A61H 15/00*** | (2006.01) |
| ***A63B 21/00*** | (2006.01) |

(52) U.S. Cl.

CPC ..... *A61H 1/008* (2013.01); *A61H 15/0092* (2013.01); *A63B 21/0726* (2013.01); *A63B 21/4035* (2015.10); *A61H 2015/0042* (2013.01)

(58) Field of Classification Search

CPC ..... A63B 21/07; A63B 21/06; A63B 23/12; A63B 23/1209; A63B 23/02

See application file for complete search history.

(56) References Cited

U.S. PATENT DOCUMENTS

| | | | | |
|---|---|---|---|---|
| 113,966 A | | 4/1871 | Ballou | |
| 421,447 A | | 2/1890 | Stewart | |
| 3,185,476 A | * | 5/1965 | Fechner | A63B 43/02 2/18 |
| D244,628 S | * | 6/1977 | Wright | D21/682 |
| 4,029,312 A | * | 6/1977 | Wright | A63B 21/0602 482/106 |

(Continued)

OTHER PUBLICATIONS

Webpages from http://www.medicineball.co.uk/products.html, accessed Dec. 14, 2015, pp. 1-6.

(Continued)

*Primary Examiner* — Garrett Atkinson

(74) *Attorney, Agent, or Firm* — Grady K. Bergen; Griggs Bergen LLP

(57) ABSTRACT

An exercise and massage device utilizes a substantially spherical body having a central cavity that extends to opposite sides of the spherical body so that the cavity forms openings on opposite sides of the spherical body. A transverse handle is positioned within the cavity that extends across the cavity. At least one grasping portion is located within the cavity and is spaced between the transverse handle and at least one of the openings of the central cavity to provide a fingerhold during use. A resilient outer layer surrounds the spherical body and provides an exterior surface of the spherical body. The resilient outer layer is provided with projections to facilitate massage when used in the massage mode when the device is used in a massage mode. The device is weighted to provide a total weight of from 2 lbs or more. In another embodiments of an exercise and massage device at least one ring member is encased within the spherical body to provide at least one of weight and structural support to the device.

20 Claims, 10 Drawing Sheets

(56) References Cited

U.S. PATENT DOCUMENTS 4,356,915 A * 11/1982 Phillips ..... B65D 85/58 206/315.1
4,632,391 A * 12/1986 Orak ..... A63B 21/0608 446/170
4,813,669 A * 3/1989 Caruthers ..... A63B 21/0605 482/105
D301,510 S * 6/1989 Orak ..... D21/684
D302,195 S * 7/1989 Orak ..... D21/682
4,854,575 A * 8/1989 Wilson ..... A63B 21/0602 482/108
4,880,228 A * 11/1989 Caruthers ..... A63B 21/0605 482/108
D321,230 S * 10/1991 Leonesio ..... D21/682
5,242,348 A * 9/1993 Bates ..... A63B 21/0004 482/105
5,433,438 A * 7/1995 Gilman ..... A63B 37/02 473/596
D372,945 S 8/1996 Morgan
5,692,944 A * 12/1997 Pellicone ..... A63B 21/0608 273/109
5,709,637 A * 1/1998 Gow ..... A63B 23/12 482/121
5,766,112 A * 6/1998 Chuan ..... A63B 21/045 482/121
5,893,808 A 4/1999 Bennett
6,312,364 B1 * 11/2001 Selsam ..... A63B 21/06 206/501
6,387,022 B1 * 5/2002 Smith ..... A63B 43/02 482/106
D469,484 S * 1/2003 Dawson ..... D21/662
6,652,421 B1 * 11/2003 Chen ..... A63B 21/0603 482/49
6,773,377 B1 * 8/2004 Yu ..... A61H 7/003 482/108
7,044,820 B2 * 5/2006 Ladisa ..... A63B 41/00 441/81
7,175,573 B1 * 2/2007 Huang ..... A63B 21/0004 446/236
7,326,122 B2 * 2/2008 Park ..... A63B 21/06 473/256
7,326,158 B1 * 2/2008 Wang ..... A63B 21/06 482/132
D575,361 S * 8/2008 Davis ..... D21/682
7,585,262 B1 * 9/2009 Vayntraub ..... A63B 23/12 482/141
D651,671 S * 1/2012 Ross ..... D21/662
D663,793 S 7/2012 Guarrasi
8,382,647 B1 * 2/2013 Hodes ..... A63B 21/072 482/108
8,454,485 B1 * 6/2013 Hodes ..... A63B 21/0726 482/108
8,469,865 B2 6/2013 Verheem
8,814,765 B2 * 8/2014 Bernstein ..... A63B 21/0004 482/110
8,852,061 B2 10/2014 Verheem
8,870,719 B2 * 10/2014 Johnson ..... A63B 21/072 482/44
9,005,146 B2 4/2015 Phillips
D745,097 S * 12/2015 Webb ..... D21/682
2001/0001094 A1 * 5/2001 Panes ..... A63B 21/06 482/93
2003/0134727 A1 * 7/2003 Yu ..... A63B 21/0004 482/110
2004/0249322 A1 * 12/2004 Cohen ..... A61H 7/001 601/131
2005/0202739 A1 * 9/2005 Ladisa ..... A63B 41/00 441/81
2005/0244795 A1 11/2005 Long et al.
2009/0222994 A1 * 9/2009 Wood ..... A61H 15/0092 5/655.9
2010/0267523 A1 * 10/2010 Wilkinson ..... A63B 21/00069 482/45
2011/0257569 A1 * 10/2011 Robins ..... A61H 15/00 601/137
2012/0135844 A1 * 5/2012 Huang ..... A63B 21/0004 482/108
2012/0184414 A1 * 7/2012 Osborn ..... A63B 21/0085 482/93
2012/0302407 A1 * 11/2012 Kelliher ..... A63B 21/22 482/45
2013/0048011 A1 * 2/2013 Bickford ..... A45D 34/041 132/320
2013/0184123 A1 * 7/2013 McLoughney .... A63B 21/0004 482/8
2013/0219583 A1 8/2013 McDonald
2013/0274076 A1 * 10/2013 Smith ..... A63B 21/065 482/105
2014/0012168 A1 * 1/2014 Carlson ..... A61H 15/0092 601/134
2015/0133275 A1 5/2015 Johnson et al.
2015/0257969 A1 * 9/2015 Shannon ..... A61H 15/00 601/121
2015/0360074 A1 12/2015 Jung

OTHER PUBLICATIONS

Webpages from https://www.performbetter.com/webapp/wcs/stores/servlet/Product2_10151_10751_1003540_-1_1000166_1000165_1000165_ProductDisplayErrorView, accessed Dec. 14, 2015, pp. 1-37.
Webpages from http://sorinex.com/cmb-or-center-mass-bells/, accessed Jul. 3, 2016; pp. 1-5.
Webpages from http://www.rogueapo.com/rogue-thompson-fatbells, accessed Jul. 3, 2016; pp. 1-11.

* cited by examiner

COMBINED EXERCISE AND MASSAGE DEVICE

CROSS-REFERENCE TO RELATED APPLICATIONS

This application is a continuation in part of U.S. patent application Ser. No. 15/069,528, filed Mar. 14, 2016, which is incorporated herein by reference in its entirety for all purposes.

TECHNICAL FIELD

The invention relates to exercise and massage devices and the uses thereof.

BRIEF DESCRIPTION OF THE DRAWINGS

For a more complete understanding of the exercise and massage device, and the advantages thereof, reference is now made to the following descriptions taken in conjunction with the accompanying figures, in which.

DETAILED DESCRIPTION

Figure 1:
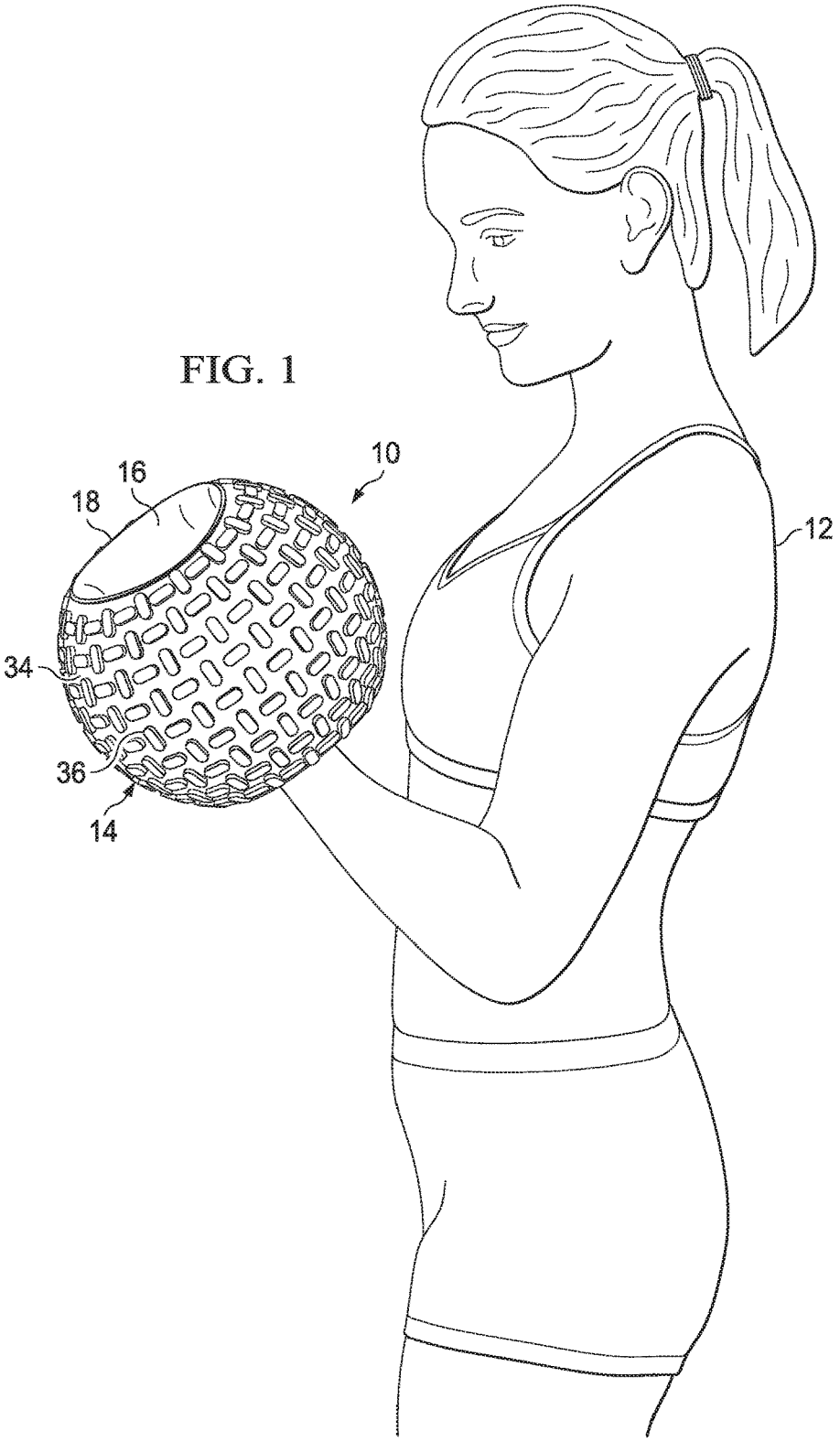
FIG. 1 is front perspective view of an exemplary embodiment of an exercise and massage device shown being used in a dumbbell or kettlebell mode of use.
Figure 2:
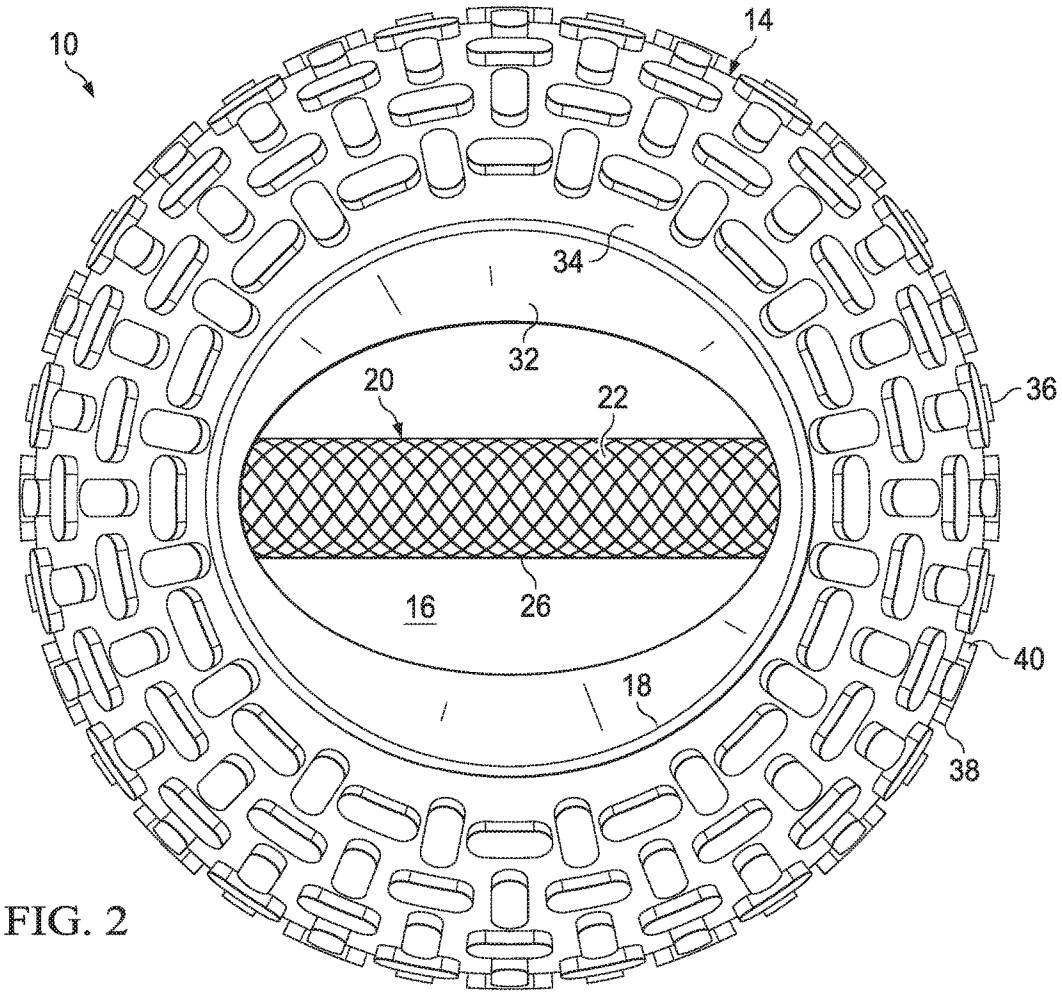
FIG. 2 is a side elevational view of the exercise and massage device of FIG. 1 showing an opening and central cavity with a handle positioned within the cavity.

Referring to FIG. 1, an exemplary embodiment of a combination exercise and massage device 10 is shown being used in a dumbbell or kettlebell mode of use by a user 12. The device 10 can be seen in greater detail in FIG. 2. As shown in FIG. 2, the device 10 comprises a substantially spherical body 14. The size of the device 10 may vary. In certain embodiments, the device 10 may have an overall spherical diameter of from 8, 9, 10, 11, 12, 13, or 14 inches to 15, 16, 17, 18, 19, or 20 inches, more typically from 8, 9, 10, or 11 inches to 12, 13, 14, 15, or 16 inches, and still more typically from 8, 8.5, 9, 9.5, or 10 inches to 10.5, 11, 11.5, or 12 inches. In many cases, the device may have an overall spherical diameter of from 8, 8.5, or 9 inches to 9.5 or 10 inches.

It should be understood that with respect to any amount or range listed or described in any summary or detailed description as being useful, suitable, or the like, it is intended to include every amount or point within the range, including the end points, and is to be considered as having been specifically stated. For example, "a range of from 1 to 10" is to be read as indicating each and every possible number along the continuum between about 1 and about 10. Thus, even if specific data points within the range, or even no data points within the range, are explicitly identified or refer to only a specific few, it is to be understood that the inventors appreciate and understand that any and all data points within the range are to be considered to have been specified, and that the inventors are in possession of the entire range and all points within the range, unless explicitly stated otherwise.

Figure 3:
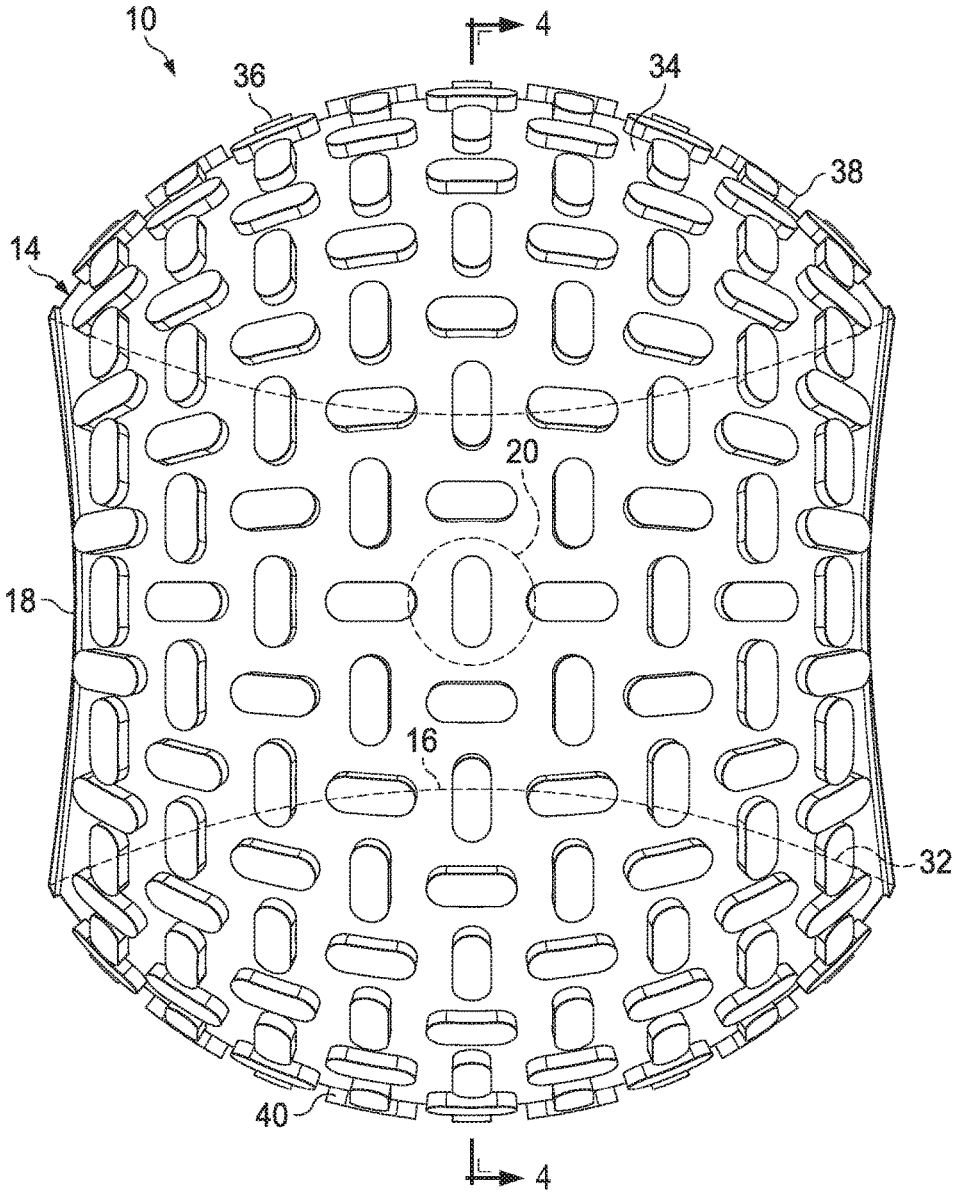
FIG. 3 is a front elevational view of the exercise and massage device of FIG. 1.

The device 10 is partially hollowed out to provide a central cavity 16 that extends to opposite sides of the spherical body 14 so that the cavity forms openings 18 on opposite sides of the body 14 (FIG. 3). The openings 18 and cavity 16 are sized and configured to allow a user to position his or her hand through either of the openings 18 and into the cavity 16.

A single rigid handle 20 is positioned within the cavity 16 and extends transversely across the cavity 16. The handle 20 will typically be centered within the body 14, with the center or midpoint of the handle 20 being located at the center of the spherical body 14. The handle 20 is typically shaped as a bar or cylinder, although it may be contoured as well. The handle 20 may have a width or diameter ranging from ¾ inch to 1½ inches. A typically width or diameter for the handle 20 is from about 1 inch to 1¼ inch. If the handle 20 is contoured, the width or diameter may vary along its length. The outer surface of the handle 20 may have surface texturing or knurling 22 to facilitate gripping of the handle 20. The handle 20 may also be provided with finger grooves (not shown) for receiving each of a user's fingers.

The handle 20 may be of solid construction or may be hollow. In the embodiment shown in FIG. 4, the handle 20 is shown with a central core 24 all or a portion of which is surrounded or encased within a sleeve, casing or outer layer of material 26. The central core 24 may be of a rigid solid material that provides structural rigidity and strength to the handle 20. This may include metal materials and non-metal materials or combinations thereof. Metal materials may include steel, iron, lead, etc. Non-metal materials may also be used, such as fiberglass, graphite, wood, plastic, composites, etc. A combination of metal and non-metal materials may also be used, such as a solid non-metal matrix with metal particulate dispersed in the matrix. The material may be selected to provide both rigidity and structural integrity for the handle 20, as well as facilitate weighting of the device 10. Heavier materials for the solid core material 24 may include metals, such as steel, iron, lead, etc.

Where less weight is desired for the handle 20, non-metal materials, such as those discussed, may be used. Where the inner core 24 provides the structural rigidity for the handle 20 the outer sleeve 26 may eliminated in some embodiments. In others, the outer sleeve, casing or layer 26 may be formed from a soft or resilient material, such as rubber, neoprene, leather, etc. to provide a comfortable grip.

In other embodiments, the outer sleeve or casing 26 may provide the structural rigidity for the handle 20. In such cases, the sleeve 26 is formed from a structurally rigid material of sufficient strength to form the handle 20. This may include fiberglass, plastic, graphite, composite materials, etc. In such cases, the handle core 24 may be hollow or may be filled with a filler material. The filler material forming the handle core 24 may be a non-rigid material or may be a material that is rigid but does not provide sufficient structural rigidity or strength to be used alone without the rigid outer sleeve or casing 26. This may include concrete, foam, particulates, sand, beads, shot (e.g., iron, steel or lead shot), resin, composites, matrix with dispersed particulate, etc. Such materials may be selected to provide a desired weight for the handle 20 to increase or decrease the weight of the device 10.

The cavity 16 and openings 18 should be sized and configured to not only allow the user to insert his or her hand within the cavity 16 but also to allow the user to manually grasp the handle 20 so that sufficient clearance is provided so that the handle 20 can be readily gripped while using the device 10. The size of the openings 18 may also be minimized to maintain as much of the spherical shape of the spherical body 14 as possible. Thus, openings 18 have a width or diameter of no more than 4½ to 6 inches may be used to accommodate most hand sizes. In some embodiments, the openings 18 may have a width that is greater than the height of the opening 18. In certain embodiments, the height may be from 3 to 4½inches, while the width may be from 4½ to 6 inches. This allows more of the spherical shape of the spherical body 14 to be maintained. The cavity 16 may have greater dimensions (i.e., width and height) than that of the openings 18. The openings 18 can have different configurations or shapes, such as circular, oval, square, rectangular, etc. In most cases, the width or greatest dimension of the opening 18 would be substantially parallel with the handle 20.

Figure 4:
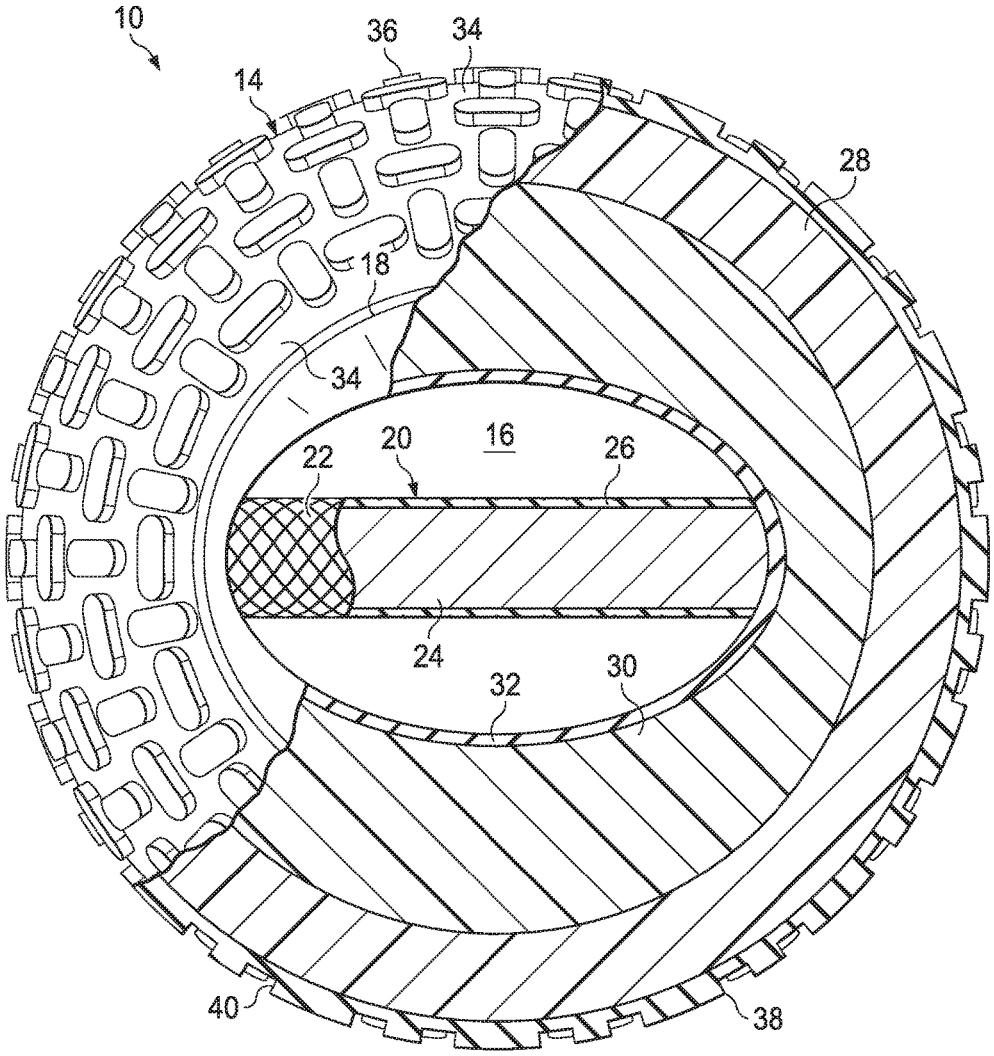
FIG. 4 is a side elevational view of the exercise and massage device of FIG. 3 that is partially sectioned along the lines 4-4.

As shown in the embodiment of FIG. 4, the spherical body 14 is composed of an outer core 28 that is substantially spherical and provides the overall shape, structural rigidity and strength of the device 10, as well as provides a degree of resiliency to the device 10. In certain embodiments, the outer core 28 of the spherical body 14 may have a Shore OO hardness of from 70 durometers or more. In particular embodiments, the outer core 28 may have a Shore OO hardness of from 70, 71, 72, 73, 74, 75, 76, 77, 78, 79, 80, 81, 82, 83, 84, or 85 durometers to 86, 87, 88, 89, 90, 91, 92, 93, 94, 95, 96, 97, 98, 99, or 100 durometers.

The outer core 28 may be formed of a variety of different materials. These may include, but are not limited to, plastic, rubber, elastomerics, vinyl, nylon, neoprene, polyvinyl chloride, polyurethane, ethyl vinyl acetate, resin, silicone, leather, etc. In some cases, a combination of metal and non-metal materials may also be used, such as a solid non-metal matrix with metal particulate, which may serve as a weighting agent, dispersed in the matrix. In some embodiments, the materials of the outer core 28 may have a density of from 0.5, 0.6, 0.7, 0.8, 0.9, 1.0, 1.1, 1.2, 1.3, 1.4, 1.5, 1.6, 1.7, 1.8, or 1.9 g/cm$^3$ to 2.0, 2.1, 2.2, 2.3, 2.4, 2.5, 2.6, 2.7, 2.8, 2.9, 3.0, 3.1, 3.2, 3.3, 3.4, or 3.5 g/cm$^3$, more particularly from 1, 1.1, 1.2, 1.3, 1.4, or 1.5 g/cm$^3$ to 1.6, 1.7, 1.8, 1.9, or 2 g/cm$^3$, to provide weight to the device 10. The thickness of the outer core 28 may vary but can range from ¼, ⅜, ½, ⅝, ¾, ⅞, 1, 1⅛, 1¼, 1⅜, 1½, or 1⅝ inches to 1¼, 1⅞, 2, 2¼, 2⅜, 2½, 2⅝, 2¾, 2⅞, or 3 inches or more, including extending from its outer surface all the way to and terminating at the central cavity 16. In specific embodiments, the outer core 28 may have a thickness of from ¼, ⅜, ½, ⅝, ¾, ⅞, 1, or 1⅛ inch to 1¼, 1⅜, 1½, or 1⅝, 1¾, 1⅞, or 2 inches, or from ¼, ⅜, ½, or ⅝ inch to ¾, ⅞ inch, or 1 inch. In other embodiments, the outer core 28 may have a thickness of from ½, ⅝, ¾, ⅞, 1, 1⅛, or 1¼ inch to 1⅜, 1½, 1⅝, 1¾, 1⅞, or 2 inches, or from ½, ⅝, or ¾ inch to ⅞ or 1 inch.

In some embodiments, the device 10 has a further inner core 30 radially inwardly adjacent to the outer core 28. The inner core 30 may be the same or a different material than the outer core 28. In still other embodiments, the outer core 28 and inner core 30 may be the same material with the inner core 30 being merely a continuation of the material of the outer core 28. The inner core 30 is hollowed out and generally defines the shape of the central cavity 16. Furthermore, the ends of the handle 20 may extend a distance into and be set, anchored, or otherwise coupled in or to the material of the inner core 30 (FIG. 4). In other embodiments, the ends of the handle 20 may extend further into and be set, anchored, or otherwise coupled in or to the material of the outer core 28.

The inner core 30 may be formed from a variety of different materials. These may be rigid or non-rigid and may be selected to give a desired weight to the device 10. Suitable materials for the inner core 30 may include, but are not limited to, plastic, rubber, elastomerics, vinyl, nylon, neoprene, polyvinyl chloride, polypropylene, polyurethane, ethyl vinyl acetate, resin, silicone, leather, concrete, foam, particulates, sand, beads, shot (steel or lead shot), resin, composites, etc. In some cases, a combination of metal and non-metal materials may also be used for the inner core, such as a solid non-metal matrix with metal particulate, which may serve as a weighting agent, dispersed in the matrix.

In some embodiments, an inner liner, layer or encasing material 32 may be provided within the cavity 16 to cover all or a portion of the inner core 30, as is shown in FIG. 4. The inner liner or layer 32 may be flexible or rigid. In some embodiments, the inner material 32 may have a thickness of from 1/16, ⅛, 3/16, or ¼ inch to 5/16, ⅜, 7/16, or ½ inch, more particularly from ⅛ inch to¼ inch. Non-limiting examples of the inner material 32 include plastic, rubber, elastomerics, vinyl, nylon, neoprene, polyvinyl chloride, polypropylene, polyurethane, ethyl vinyl acetate, resin, silicone, leather, etc. The liner, layer or encasing material 32 may serve merely as a cover for the inner core 30 or may serve as a containment layer of sufficient structural rigidity and strength so that it contains the material of inner core 30 when the material of the inner core 30 is non-rigid or lacks sufficient structural rigidity or strength to be used alone without the liner or layer 32. Examples of material for the inner core 30 that may lack this structural rigidity or strength may include concrete, foam, particulates, sand, beads, shot (steel or lead shot), resin, matrix material, etc.

In some embodiments, the ends of the handle 20 may engage and be held, anchored, or coupled solely in or to the material of the inner liner or casing 32. The inner material 32 may also be molded or formed with all or a portion of the handle 20. For example, the inner material 32 may be formed or molded with the outer sleeve 26 of the handle 20 so that they form a single unitary piece or assembly. The core 24 may be a separate piece that is then held or contained within the sleeve 26 of this unitary assembly. In other instances, the inner material 32 may be molded or formed with the inner core 24 of the handle 20 so that they form a single unitary piece or assembly. The outer sleeve 26, if provided, may be a separate piece that is added to cover the handle core 24 of this unitary assembly.

In certain embodiments, the inner core 30 may be a fluid-tight bladder that can be filled with a fluid, such as a liquid or gas (e.g., air) through a valve (not shown) that communicates with the bladder. In some instances, the bladder of the inner core 30 may be formed by the surfaces of the outer core 28 and the inner liner or material 32, which may be fluid tight materials so that the volume of space between the outer core 28 and inner liner 32 forms the bladder or inner core 30, the inner core 30 constituting a fluid, such as a liquid or gas (e.g., air). In other embodiments, a separate self-contained bladder may be positioned between the outer core 28 and the inner liner or material 32. If a gas is used for the inner core 30, this may facilitate providing a degree of bounce to the device 10. In contrast, if the inner core 30 is a liquid, this may contribute to impact absorbing properties of the device 10, which may be desirable in certain instances. In some embodiments, the inner core 30 can be filled with the same or different selected materials through a suitable valve mechanism (not shown) to give different properties to the device. Changing the amounts (increased or decreased pressure) or types of materials (liquid or gas) can change the properties of the device 10, providing the desired degree of bounce or resiliency or change its impact absorbing properties.

As can be seen in FIGS. 2-4, all of the outer surface or substantially all of the outer surface of the outer core 28 is covered with an outer layer 34 of resilient material. The outer layer 34 may be of unitary construction or formed as one piece. In other embodiments, the outer layer 34 may be formed of several pieces that cover all or substantially all of the outer surface of the outer core 28.

The outer layer 34 is formed from a resilient material having a resilient hardness that is less than that of the resilient hardness of the outer core 28 to provide a cushioning effect when the device 10 is used in a massage mode. Examples of materials for the outer layer 34 include, but are not limited to, plastic, rubber, elastomerics, vinyl, nylon, neoprene, polyvinyl chloride, polypropylene, polyurethane, ethyl vinyl acetate, resin, silicone, leather, etc. Particularly useful materials for the outer layer 34 are resilient foam materials, which may be an opened or closed cell foam material. Rubber or neoprene foam is particular useful for the outer layer 34. In certain embodiments, the resilient outer layer 34 surrounding the outer core 28 of the spherical body 14 may have a Shore OO hardness of less than 60, 61, 62, 63, 64, 65, 66, 67, 68, 69, or 70 durometers. In particular embodiments, the outer layer 34 may have a Shore OO hardness of from 10, 11, 12, 13, 14, 15, 16, 17, 18, 19, 20, 21, 22, 23, 24, 25, 26, 27, 28, 29, 30, 31, 32, 33, 34, or 35 durometers to 36, 37, 38, 39, 40, 41, 42, 43, 44, 45, 46, 47, 48, 49, 50, 51, 52, 53, 54, 55, 56, 57, 58, 59, or 60 durometers.

The thickness of the outer layer 34 may range from ¼, 5/16, ⅜, 7/16, ½, 9/16, ⅝, 11/16, ¾, 13/16, or ⅞ inch to 15/16, 1, 1 1/16, 1⅛, 1 3/16, 1¼, 1 5/16, 1⅜, 1 7/16, or 1½ inches in some instances. In particular embodiments the outer layer 34 may have a thickness of from ½, 9/16, or ⅝ inch to ¾, 13/16, ⅞, 15/16, or 1 inch.

The outer layer 34 may be formed with or otherwise provided with a plurality of small projections 36. The projections 36 may cover all or a portion of the outer layer 34. The projections 36 may be formed from the same or similar materials to that of the outer layer 34 and may be molded or formed with the outer layer 34 as a single unitary piece or assembly. In other embodiments, the projections 36 may be separate pieces that are coupled to the exterior surface of the outer layer 34 with suitable coupling means (e.g., mechanical fasteners, glue, epoxy, heat welding, injection molding, etc). In such instances, the projections 36 may be formed from the same or different materials than those of the outer layer 34. In certain cases, the projections 36 may have a resilient hardness that is greater than that of the outer layer 34. In such instances, all or a portion of the projection 36 may have a Shore OO hardness of from 70, 71, 72, 73, 74, 75, 76, 77, 78, 79, 80, 81, 82, 83, 84, or 85 durometers to 86, 87, 88, 89, 90, 91, 92, 93, 94, 95, 96, 97, 98, 99, or 100 durometers. In cases where the projections 36 have a greater resilient hardness, the outer layer 34 should have a sufficient thickness and lower resilient hardness such that the outer layer 34 provides a cushioning effect. In other instances, the projections 36 may have a resilient hardness that is the same or less than that of the outer layer 34.

The projections 36 may have a height or project from the surface of the outer layer 34 a distance of from 1/16, ⅛, 3/16, ¼, 5/16, or ⅜ inch to 7/16, ½, 9/16, ⅝, 11/16, or ¾ inch. In particular embodiments, the projections 36 may project a distance of from 1/16, ⅛, 3/16, or ¼ inch to 5/16, ⅜, 7/16, or ½ inch from the surface of the outer layer 34. The projections 36 may all be of uniform height or the height of the projections 36 may vary. The projections 36 may have a variety of different configurations and sizes. The size of each of the projections 36 of the device 10 may be the same or may vary, with projections 36 of different sizes and configurations being used on the same device 10. The projections 36 may be in the form of discrete projections with well defined perimeters and side edges that intersect the outer surface of the projections 36 at well defined angles or corners 38 and straight sidewalls 40 that intersect the outer surface of the outer layer 34 at well defined angles or corners. Alternatively, the projections 36 may have curved or rounded corners 38 and/or curved sidewalls 40 that extend from the corners 38. In some cases, the projections 36 may have curved corners 38 and sidewalls 40 to form gradual undulations that gradually rise and recede into and merge with the surface of the outer layer 34. In some embodiments, some but not all of the projections 36 of the device 10 may have angular corners 38 with well defined side edges and/or straight sidewalls 40, while others may have curved or rounded corners 38 and/or curved sidewalls 40, and some may form gradual undulations that gradually rise and recede into and merge with the surface of the outer layer 34. The projections 36 may also constitute rounded or spherical nodules formed on the outer surface of the outer layer 34. In certain embodiments, the projections 36 may be elongated ridges that extend around all or a portion of the circumference of the device 10.

In certain embodiments, each projection 36 may cover a surface area of the outer layer 34 ranging from 0.015 $in^2$ to 9 $in^2$. In other embodiments, each projection 36 may cover a surface area of the outer layer 34 of from 0.125 $in^2$ to 1 $in^2$. In some embodiments, from 10%, 15%, 20%, 25%, 30%, 35%, 40%, 45%, or 50% to 55%, 60%, 65%, 70%, 75%, 80%, 85%, or 90% of the outer layer 34 may be covered with projections 36. In particular embodiments, from 25%, 30%, 35%, 40%, 45%, or 50% to 55%, 60%, 65%, 70%, or 75% of the outer layer 34 may be covered with projections 36.

When all the components making up the device 10 are combined, the materials forming the device 10 provide a total weight of the device of from 2 lbs or more. In particular embodiments, the total weight of the device 10 may range from 2, 3, 4, 5, 6, 7, 8, 9, 10, 11, 12, 13, 14, 15, 16, 17, 18, 19, 20, or 25 lbs to 30, 35, 40, 45, or 50 lbs. In some embodiments, the total weight of the device 10 may range from 2, 3, 4, 5, 6, 7, 8, 9, 10, 11, 12, 13, 14, or 15 lbs to 16, 17, 18, 19, 20, 25, or 30 lb. In still other embodiments, the total weight of the device 10 may range from 2, 3, 4, 5, 6, 7, 8, 9, 10, 11, or 12 lbs to 13, 14, 15, 16, 17, 18, 19, 20, 21, 22, 23, 24, or 25 lbs.

In use, the device 10 may be used in a variety of different ways. The device 10 may be provided as a set in a variety of different weights and sizes. In certain instances, pairs of the devices 10 may be provided of the same size, shape and weight so that they can be used as uniform pairs, with one device 10 being held in each hand.

Referring to FIG. 1, the device 10 is shown in use in a dumbbell or kettlebell mode. In this mode, one of the devices 10 is held by the user inserting his or her hand through one of the openings 18 and into the cavity 16 and grasping the handle 20 in a manner similar to grasping a dumbbell or kettlebell. The user may then perform various lifting exercises (e.g., curls) or movements with the device or devices 10 being held in a user's hand or hands by the handle 20.

The device 10 may also be placed on the floor or a support surface with the user grasping the handle 20 while the device 10 is resting or held on the support surface while performing a push up or similar movements.

Figure 5:
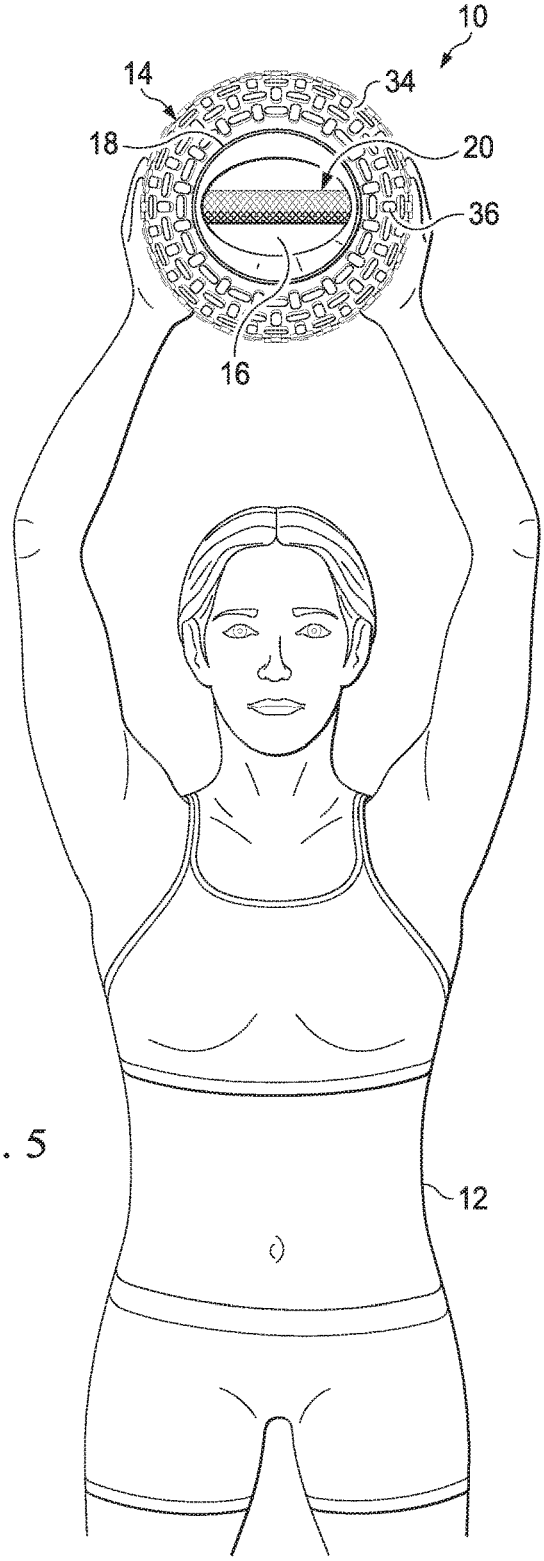
FIG. 5 is side elevational view of the exercise and massage device of FIG. 1, shown being used in a medicine or slam-ball mode of use.

Referring to FIG. 5, the device 10 is shown being used in a medicine ball or slam ball mode of use. The device 10 may be thrown, swung or otherwise moved by the user while holding the outer periphery of the device 10. Various exercises may then be performed while holding the device 10 in this manner. The projections 36 may facilitate gripping or holding of the device 10. The device 10 may also be thrown against a surface, as with a slam ball, or may be thrown into the air and caught or thrown to a different user who the catches the device 10. In certain instances, a rope or flexible cord or strap (not shown) may be tied to the handle 20 and the device 10 may be swung or moved by holding the rope, cord or strap.

Figure 6:
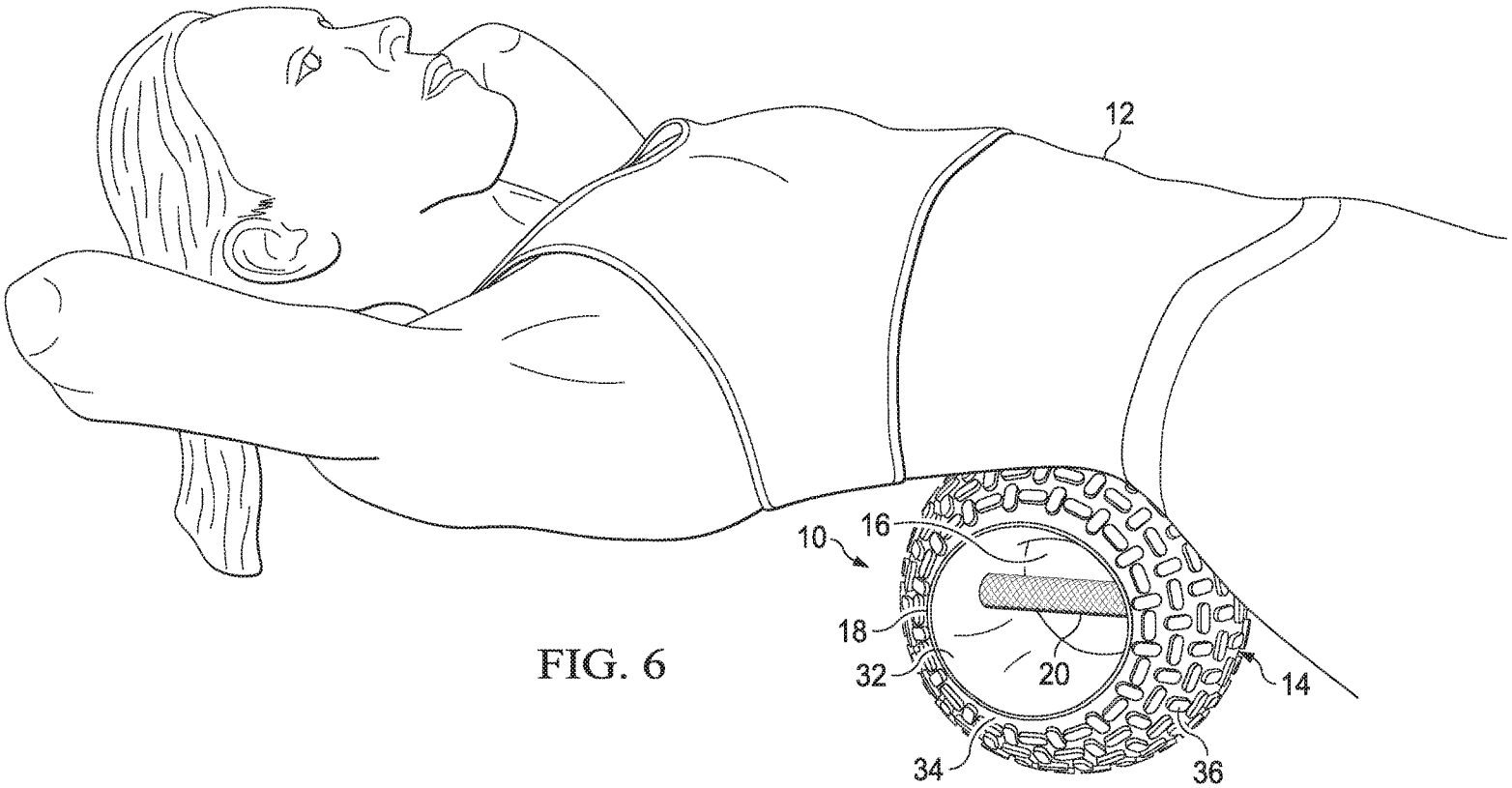
FIG. 6 is a perspective view of the exercise and massage device of FIG. 1, shown being used in massage mode of use.

Referring to FIG. 6, the device 10 is shown being used in a massage mode of use. In this mode, the device 10 is rolled along portions of a user's body to perform massage or myofascial release. The softer outer layer 34 provides a certain degree of give or cushioning effect, while the harder outer core 28 provides a rigid support surface to provide sufficient pressure to the user's body to facilitate massage or myofascial release. The projections 36 provide more isolated pressure points that facilitate massaging. The device 10 may be used as shown in FIG. 6, wherein the user may use the device 10 as a massage roller that can be rolled along portions of the user's body, such as when pressing the user's body against the device 10 when it is supported on a support surface (e.g., floor or wall). Alternatively, another user may roll the device 10 over portions of the user's body, either relying on the weight of the device 10 itself to provide the desired pressure, with no or little added pressure, or applying additional pressure to the device 10 as it is rolled over user's body.

Figure 7:
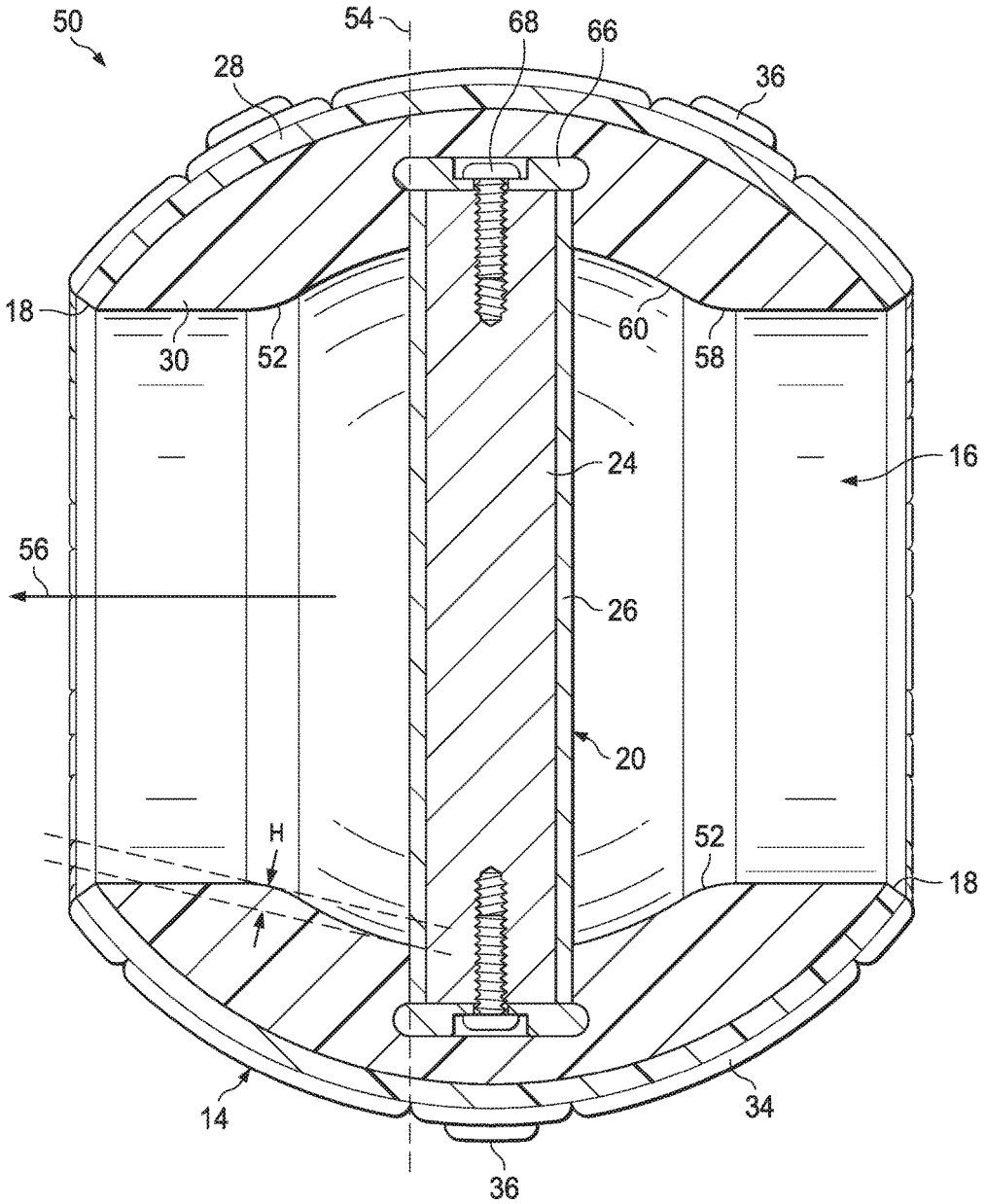
FIG. 7 is a longitudinal cross-sectional side view of another exemplary embodiment of an exercise and massage device employing a grasping portion located within a central cavity of the device.

Referring to FIG. 7, another exemplary embodiment of a combination exercise and massage device 50 is shown. The device 50 is similar to the device 10, with similar components labeled with the same reference numerals. The device 50 lacks the inner liner 32 so that the inner core 30 is exposed with the surface of the inner core 30 forming a sidewall surface of cavity 16. In other variations, an inner liner, such as the inner liner 32 of the device 10, may be provided and which may form the sidewall surface of the cavity 16.

The device 50 is provided with a grasping portion 52 located within the cavity 16 that is spaced between the transverse handle 20 and at least one of the openings 18 of the central cavity 16. The grasping portion 52 is configured as a ridge, lip, or other projecting portion that allows a user to achieve a fingerhold in a second mode of use wherein the user may grasp the device 50 without grasping the handle 20. The grasping portion 52 may be formed as a continuous or non-continuous annular ridge, lip, or other projecting portion that extends around all or only a portion of the perimeter of the central cavity 16. Each opening 18 may be provided with a corresponding grasping portion 52 so that the corresponding grasping portion may be accessed from one of the openings 18.

The grasping portion 52 is located at a distance that allows the user's fingers to engage the grasping portion 52. In particular embodiments, this distance may be from ½ inch to 4 inches from the opening 18 of the device 50. In other embodiments, the grasping portion 52 may be located at from 1 inch to 3 inches from the opening 18.

The grasping portion 52 may have a height H of from ⅜ inch to 1 inch. As used herein, the height H of the grasping portion 52 may be defined as the distance between a line touching the top or uppermost point of the grasping portion 52 that is parallel to a line passing from the surface of the cavity 16 where the edge of handle 20 closest to the opening 18 intersects the central cavity 16 to the edge of the opening 18, as is shown in FIG. 7. The points at where the handle 20 intersects the central cavity 16 are those points lying in a plane 54 that is substantially perpendicular to the direction of the opening, as represented by the arrow 56 where the outer edge of the handle 20 intersects the cavity 16. In particular embodiments, the height H may be from ⅜ inch to ½ inch or ¾ inch.

The grasping portion 52 may have a variety of different configurations. In the embodiment of FIG. 7, the portion 52 is in the form of annular ridge having substantially straight outer wall 58 that extends toward the opening 18 and a slightly concave inner wall 60 located on either side of the apex of the grasping portion 52.

Figure 8:
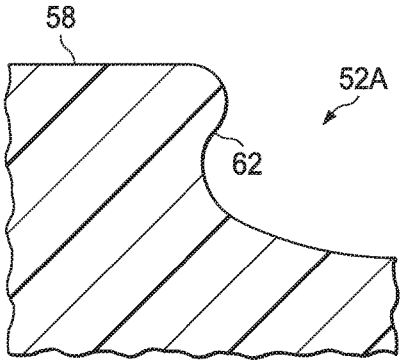
FIG. 8 is a cross-sectional view of another exemplary embodiment of a grasping portion that may be used with the devices of FIGS. 1 and 7.
Figure 9:
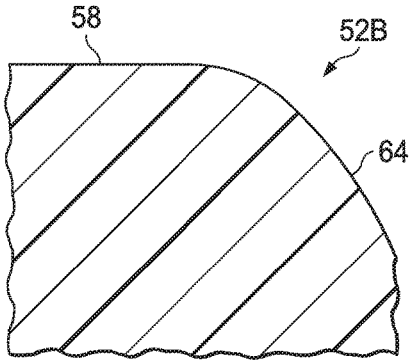
FIG. 9 is a cross-sectional view of still another exemplary embodiment of a grasping portion that may be used with the devices of FIGS. 1 and 7.

As shown in FIG. 8, another grasping portion 52A is shown having a concave, undercut inner wall 62. FIG. 9 shows a grasping portion 52B having a convex inner wall 64. Other configurations for the grasping portion 52 may be used as well.

In use, the device 50 may be used in a similar manner to that previously described for the device 10. In the device 50, however, the grasping portions 52 allow the device 50 to be used more effectively in a mode of use where the device 50 functions even more like a kettlebell. In this mode of use, instead of grasping the handle 20, the user inserts the user's hand through the opening into the cavity 16 so that the hand is positioned just through the opening 18 with the palm side of the fingers passing over and being positioned over the interior surface of the cavity 16 and over the grasping portion 52. By curling the user's fingers slightly, the device 50 can be lifted while the user's fingers are maintained in this position. This results in altering the position of the center of gravity of the device 50 from that where the user lifts the device by grasping the handle 20. Grasping the device 52 in this manner causes the center of gravity to be more directly located below the user's hand and thus lifting the device 52 is more like the lifting of a kettlebell where the center of gravity is typically located below the handle when the kettlebell is lifted. The grasping portion 52 aids in the user maintaining the user's grip on the device 50 and prevents the user's fingers and hand from inadvertently slipping out of the cavity 16 and through the opening 18 during use.

In the embodiment of FIG. 7, the device 50 further includes a ring member 66. The ring member 66 extends around the central cavity and provides structural support and/or weight to the device 50. As shown, the ring member 66 is embedded or encased with the material of the spherical body 14, such as in the material of the inner core 30 and/or outer core 28.

Figure 10:
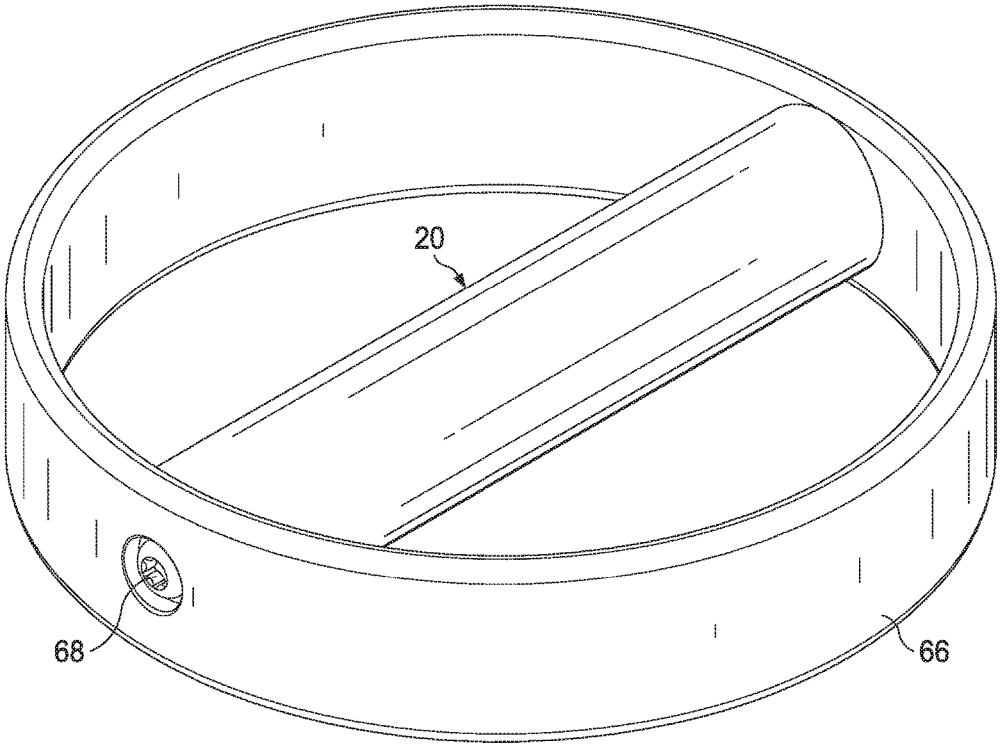
FIG. 10 is a perspective view of a ring member configured for use in the exercise and massage device of FIG. 7.

FIG. 10 shows a perspective view of the ring member 66. The ring member 66 may be formed from a structurally rigid material where it is provided to provide structural support. Examples of such materials include steel, iron, stainless steel, graphite, lead, fiberglass, graphite, wood, plastic, composite materials, and combinations of these. The ring member 66 may be a continuous band or a rod bent or configured into an overall circle or oval shape. Where the ring member 66 is configured as a band, it may have a generally flat transverse cross section or the transverse cross section may be curved across its length, such as to accommodate contours of the spherical body 16. If the ring member is configured as a rod, it may have a circular or oval transverse cross section, although non-circular or non-oval configurations may be used as well.

Figure 11:
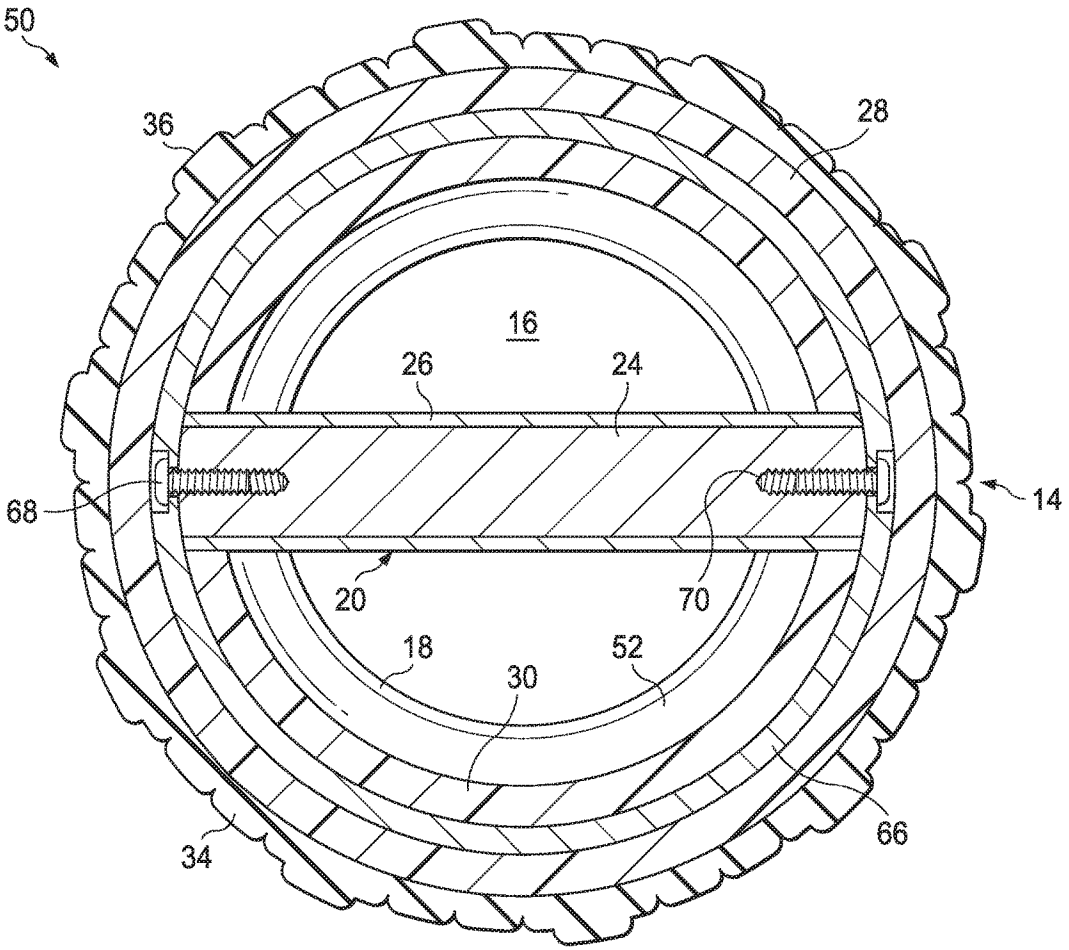
FIG. 11 is a transverse cross-sectional elevational view of the exercise and massage device of FIG. 7 employing the ring member of FIG. 10.

As can be seen in FIG. 10, the ring member 66 is provided for structurally supporting the handle 20. The handle 20 is coupled to the ring member 66 at each end by means of mechanical fasteners 68. As shown in FIG. 11, the handle 20 of the device 50 is formed as a solid piece of material (e.g., steel), that is provided with threaded apertures 70 for receiving threaded bolts 68 for coupling the handle 20 to the ring member 66. By embedding or encasing the ring member 66 within the spherical body 14, such as in the outer core 28 and/or inner core 30, the handle 20 is securely fastened to the spherical body 14 within the cavity 16.

Figure 12:
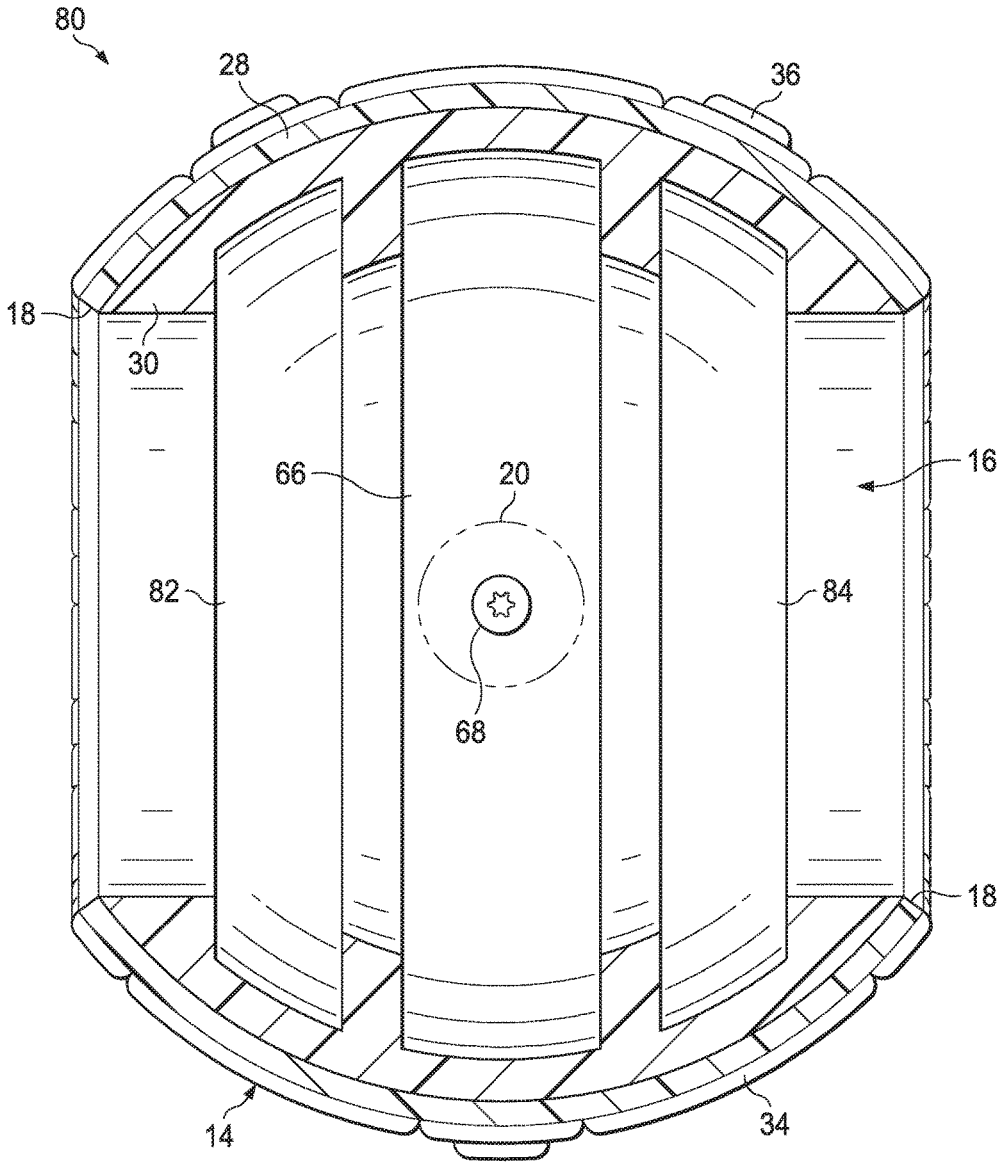
FIG. 12 is a transverse cross-sectional view of still another exemplary embodiment of an exercise and massage device employing multiple ring members.

Referring to FIG. 12, another exemplary embodiment of a combination exercise and massage device 80 is shown. The device 80 is similar to the devices 10 and 50, with similar components labeled with the same reference numerals. The device 80 includes the ring member 66, as with the device 50, but also includes additional ring members 82, 84. The ring members 82, 84 are positioned to either side of the ring member 66.

The ring members 82, 84 may be configured and sized the same or differently than the ring member 66. The ring members 82, 84 may each be a continuous band or rod bent or configured into an overall circle or oval shape. Where the ring members 82, 84 are configured as a band, they may have a generally flat transverse cross section or the transverse cross section may be curved across its length, such as to accommodate contours of the spherical body 16. If the ring member is configured as a rod, it may have a circular or oval transverse cross section, although non-circular or non-oval configurations may be used as well. Different configurations may be provided to accommodate the shape and contours of the spherical body 14.

The ring members 82, 84 may be constructed from the same or different materials than the ring member 66. Examples of such materials include steel, iron, stainless steel, graphite, lead, fiberglass, graphite, wood, plastic, composite materials, and combinations of these. Where the ring members 82, 84 are used for weighting purposes, heavier or lighter materials may be used depending upon the desired weight of the device 80. The ring members 82, 84 are embedded or encased with the material of the spherical body 14, in the material of the inner core 30 and/or outer core 28.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. An exercise and massage device comprising:

a substantially spherical body having a central cavity that extends to opposite sides of the spherical body so that the cavity forms openings on opposite sides of the spherical body;

a transverse handle that is positioned within the cavity that extends across the cavity, the openings of the cavity being sized and configured for allowing a user to access and manually grasp the handle through either opening in a first mode of use;

at least one grasping portion located within the cavity that is spaced between the transverse handle and at least one of the openings of the central cavity to provide a fingerhold in a second mode of use, and wherein the grasping portion is a projecting ridge or lip that projects within the cavity from a sidewall of the cavity;

a resilient outer layer surrounding the spherical body that provides an exterior surface of the spherical body, the resilient outer layer being provided with projections to facilitate massage when used in the massage mode when the device is used in a massage mode; and wherein the device is weighted to provide a total weight of the device of from 2 lbs or more.

2. The device of claim 1, wherein:

the resilient outer layer overlays and covers opposite ends of the transverse handle.

3. The device of claim 1, wherein:

the projecting ridge or lip is annular.

4. The device of claim 1, wherein:

there are two projecting ridges or lips, each projecting ridge or lip corresponding to one of the openings.

5. The device of claim 1, wherein:

the at least one projecting ridge or lip is located at a distance of from ½ to 4 inches from the at least one opening.

6. The device of claim 1, wherein:

the at least one projecting ridge or lip has a height of from ⅜ inch to 1 inch.

7. The device of claim 1, wherein:

the at least one projecting ridge or lip has a concave inner surface.

8. The device of claim 1, wherein:

each end of the transverse handle is coupled to a support ring member encased within the spherical body that extends around the central cavity.

9. The device of claim 1, further comprising:

at least one ring member encased within the spherical body that extends around the central cavity that provides at least one of weight and structural support to the device.

10. An exercise and massage device comprising:

a substantially spherical body having a central cavity that extends to opposite sides of the spherical body so that the cavity forms openings on opposite sides of the spherical body;

a transverse handle that is positioned within the cavity that extends across the cavity, the openings of the cavity being sized and configured for allowing a user to access and manually grasp the handle through either opening in a selected mode of use;

at least one ring member encased within the spherical body that extends around the central cavity that provides at least one of weight and structural support to the device;

a resilient outer layer surrounding the spherical body that provides an exterior surface of the spherical body and overlays and covers opposite ends of the transverse handle, the resilient outer layer being provided with projections to facilitate massage when the device is used in a massage mode; and wherein the device is weighted to provide a total weight of the device of from 2 lbs or more.

11. The device of claim 10, wherein:

each end of the transverse handle is coupled to the ring member.

12. The device of claim 10, wherein:

there are at least two ring members.

13. The device of claim 10, wherein:

there are at least two ring members, with each end of the transverse handle being coupled to one of the ring members.

14. The device of claim 10, wherein:

the ring member is a continuous metal ring member.

15. The device of claim 10, wherein:

the ring member is formed from at least one of steel, iron, stainless steel, graphite, lead, fiberglass, graphite, wood, plastic, and composite materials.

16. The device of claim 10, further comprising:

at least one projecting ridge or lip that projects within the cavity from a sidewall of the cavity and is spaced between the transverse handle and at least one of the openings of the central cavity to provide a fingerhold during a second selected mode of use.

17. The device of claim 16, wherein:

the projecting ridge or lip is annular.

18. The device of claim 16, wherein:

the at least one projecting ridge or lip is located at a distance of from ½ to 4 inches from the at least one opening.

19. The device of claim 16, wherein:

the at least one projecting ridge or lip has a height of from ⅜ inch to 1 inch.

20. The device of claim 16, wherein:

the at least one projecting ridge or lip has a concave inner surface.

* * * * *